United States Patent [19]

Jansen

[11] 4,379,048

[45] Apr. 5, 1983

[54] FLOAT-AND-SINK SEPARATOR

[75] Inventor: Johann J. Jansen, CZ Nieuwstadt, Netherlands

[73] Assignee: Stamicarbon, B.V., Geleen, Netherlands

[21] Appl. No.: 314,082

[22] PCT Filed: Feb. 13, 1981

[86] PCT No.: PCT/NL81/00002

§ 371 Date: Oct. 13, 1981

§ 102(e) Date: Oct. 13, 1981

[87] PCT Pub. No.: WO81/02259

PCT Pub. Date: Aug. 20, 1981

[30] Foreign Application Priority Data

Feb. 16, 1980 [NL] Netherlands ..... 8000978

[51] Int. Cl.[3] ..... B03B 5/36

[52] U.S. Cl. ..... 209/172.5; 209/172

[58] Field of Search ..... 209/172–173, 209/461, 462

[56] References Cited

U.S. PATENT DOCUMENTS

| | | | |
|---|---|---|---|
| 2,752,040 | 6/1956 | Schreiber et al. | 209/173 |
| 2,825,459 | 3/1958 | Schuetz | 209/172.5 |
| 2,825,460 | 3/1958 | Schuetz et al. | 209/172.5 |
| 3,016,144 | 1/1962 | Leeman | 209/172.5 |
| 3,399,769 | 9/1968 | Cherkov et al. | 209/172.5 |

FOREIGN PATENT DOCUMENTS

| | | | |
|---|---|---|---|
| 2355744 | 11/1973 | Fed. Rep. of Germany . | |
| 1191989 | 10/1959 | France | 209/172 |
| 939128 | 10/1963 | United Kingdom | 209/175.5 |

*Primary Examiner*—Ralph J. Hill

[57] ABSTRACT

Washing tank for separating particles differing the specific gravity by means of a liquid separatory medium using the float-and-sink method. The washing tank is provided with at least one collecting tray for removing the settled particles, which collecting tray can be reciprocated along the bottom of the washing tank and in the first extreme position is about centrally on the bottom of the washing tank, where it can collect settling particles, and in the second extreme positions rests on the edge of the washing tank, so tilted that settled particles contained in it can slide into a discharge device positioned next to the washing tank. Preferably, the washing tank is provided with two alternating collecting trays hingingly attached to arms fixed on a horizontal shaft swinging to and fro between two extreme positions.

6 Claims, 3 Drawing Figures

FLOAT-AND-SINK SEPARATOR

BACKGROUND AND SUMMARY OF INVENTION

The invention relates to apparatus for separating particles differing in specific gravity by means of a liquid separating medium, using the float-and-sink method, the apparatus comprising a washing tank with means movable along its bottom for removing the settled particles and with means for removing the floating particles.

Apparatus of this kind is known, for instance, from the British Patent Specification No. 868,832. In this apparatus the means for removing the settled particles which move along the tank bottom take the form of a scraper chain. For the purpose for which this known apparatus was designed, viz. separating useful minerals from rock, more in particular separating coal from shale, this is very satisfactory. However, it is not so if the material to be separated according to specific gravity tends to get tangled in itself and to cling to the scraper chain so that this can jam. Such a difficult-to-work material is, for instance, the scrap coming from shredders in which wrecked or disused cars, disused domestic appliances, etc. are disintegrated. The ferromagnetic components of the scrap leaving the shredder are generally separated from the non-ferromagnetic components by means of a magnetic separator. The non-ferromagnetic part of the scrap contains components widely differing in specific gravity, e.g. non-metals, such as plastics, wood and rubber, lighter metals and alloys, such as aluminium and aluminium alloys, and heavier metals, such as copper, lead, stainless steel, etc. It is the object of the invention to provide float-and-sink apparatus of the type described above which can, without objection, also be used for separating such a difficult-to-handle material according to specific gravity.

According to the invention, the said means movable along the bottom of the washing tank for removing the settled particles can be moved between two extreme positions so that during the movement from at least one of the extreme positions to the other extreme position they can transport settled particles across the edge of the washing tank to a discharge point.

According to the invention, the said means for removing the settled particles preferably comprise at least one collecting tray that can be reciprocated along the bottom of the washing tank, which collecting tray in the first extreme position is about centrally on the bottom of the washing tank where it can collect settling particles, and in the second extreme position rests on the edge of the washing tank, so tilted that the settled particles contained in it can slide into a discharge device positioned next to the washing tank, for which purpose the collecting tray is open at the discharge side. In addition, there may be a collecting plate moving along with the collecting tray, on which plate particles settling during the travel of the collecting tray are collected, and across which these particles can slide into the collecting tray when this is travelling back to its starting position. By preference the apparatus is provided with a second collecting tray that can move, in a similar way as described for the first collecting tray, between two extreme positions, and which rests about centrally on the bottom of the washing tank when the first collecting tray has reached its tilted position on the edge of the washing tank, and rests tilted on the opposite edge of the washing tank when the first collecting tray is approximately centrally positioned on the bottom of the washing tank. This second collecting tray can likewise cooperate with a collecting plate as described above.

According to the invention, the mechanism reciprocating the collecting trays with the collecting plate (if present) between the extreme positions is preferably so designed that the collecting trays are hingingly attached to one or more arms fixed on a horizontal shaft provided with driving means for swinging to and fro between two extreme positions the shaft with the arms and the collecting trays hingingly attached to them. If a collecting plate is used, this is preferably also attached to the said arm(s).

BRIEF DESCRIPTION OF THE ACCOMPANYING DRAWINGS

The invention will be elucidated with reference to the drawing, which shows a non-restrictive example. The figures show:

FIG. 1: a diagrammatic representation of the top view of apparatus according to the invention;

FIG. 2: a diagrammatic representation of a vertical section along the line II—II in FIG. 1;

FIG. 3: a diagrammatic representation of a vertical section along the line III—III in FIG. 1.

DETAILED DESCRIPTION OF THE PREFERRED EXEMPLARY EMBODIMENT

Figure 1:
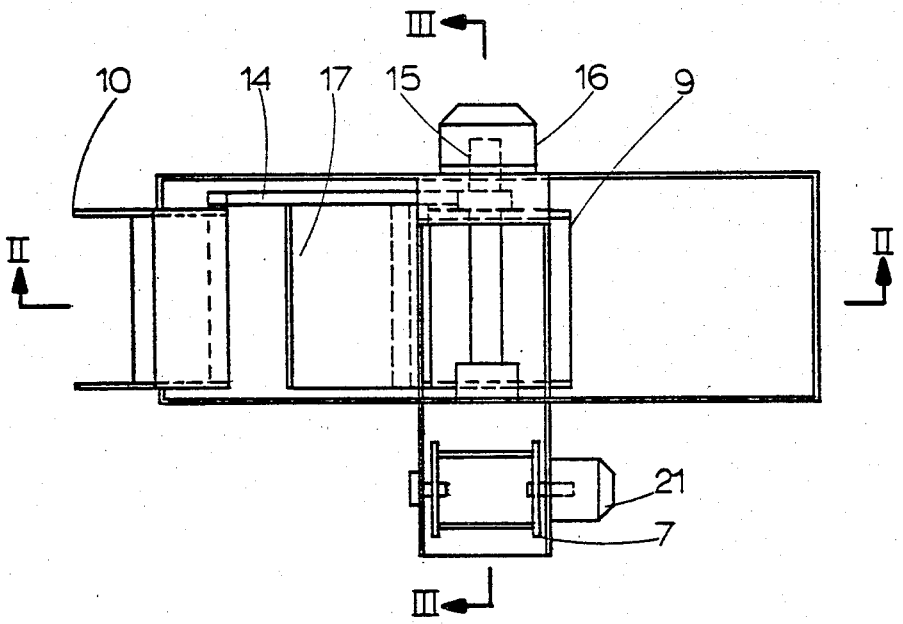
Figure 2:
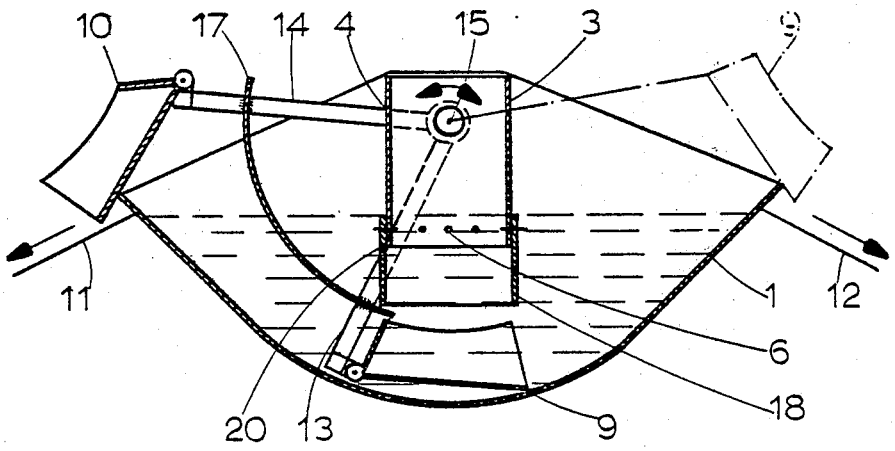
Figure 3:
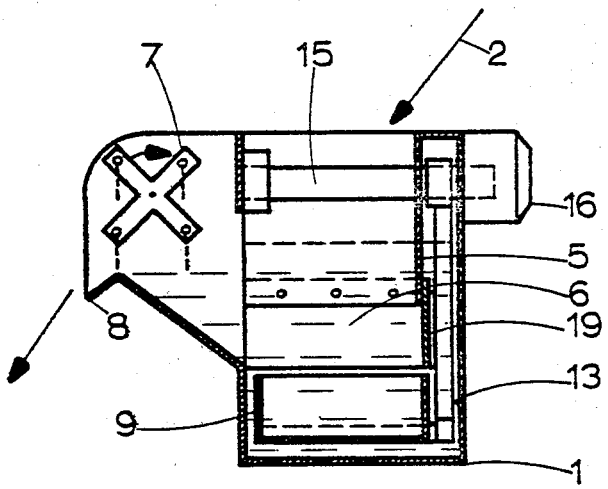

These diagrams only show what is needed for a good understanding of the invention; not shown are, for instance, the parts which serve for the circulation and the regeneration of the separatory medium, and the actuation and control system of the motors.

In a washing tank 1 the material to be separated, for instance scrap from a shredder, with a maximum size of the pieces of about 400 mm, from which the ferromagnetic components have already been removed, is introduced by means of a feed device 2.

The washing tank contains a liquid separatory medium, for instance a suspension of finely-ground ferrosilicon or magnetite in water, having a specific gravity of 1.4, in which metallic components of the scrap will sink and lighter components, such as plastics, rubber, wood, etc., will float. In the washing tank a separatory compartment is partitioned off by partitions 3, 4 and 5 extending vertically into the liquid, from which compartment the floating pieces are carried to a discharge point 8 by means of a paddle wheel 7. The settling pieces are collected under the separatory compartment 6 in collecting trays 9 and 10. In the extreme position shown in the drawing, collection tray 9 is about centrally on the bottom of the washing tank under separatory compartment 6; collecting tray 10 rests, tilted, on the edge of the washing tank, so that the contents of this collecting tray can slide to a discharge device 11. In the other extreme position collecting tray 10 is under the separatory compartment, and collecting tray 9 rests tilted on the opposite edge of the washing tank, as shown by the dot-dash line; now collecting tray 9 empties its contents into discharge device 12.

Collecting trays 9 and 10 are hingingly attached to arms 13 and 14, which are fixed on a horizontal shaft 15. This shaft 15, with the arms 13 and 14 attached to it and the trays 9 and 10, can be reciprocated between two extreme positions by a motor 16, preferably a hydraulic motor. A collecting plate 17 is fixed to the arms 13 and 14, on which plate settling pieces from compartment 6 are collected during the time no collecting tank is under this compartment; the pieces collected on this plate 17 then slide into the collecting tray moving to the bottom position.

The bottom edges of the partitions 3, 4 and 5 are at such a distance over the upper edges of the trays 9 and 10 that there is no danger of pieces projecting beyond the upper edges of trays 9 and 10 getting jammed; the partitions 3, 4 and 5 have downward extensions in the form of strips of flexible material 18, 19 and 20, which may be rubber, but may also be formed by, e.g., curtains of chains, and which extend to close over the edges of the tanks 9 and 10. The upright walls of the collecting trays, or at least the back walls, should be provided with openings, to prevent the collecting trays scooping an undue quantity of separatory medium across the edge of the washing tank.

Preferably, the motor 16 has discontinuous control, in such a way that the two collecting trays 9 and 10 alternately rest for a certain time on the bottom of the washing tank in their bottom position, collecting settling particles that are to be carried off. This 'certain' time should of course, be so chosen, that the collecting trays get properly filled, but not overfilled; if desired, this time may be made dependent on the load of the machine. The motor 16 is by preference a hydraulic motor, as this can immediately produce its maximum torque when moving from standstill.

The paddle wheel 7 is driven by a motor 21, which, if motor 16 is a hydraulic motor, preferably a hydraulic motor also.

The specific gravity of the separatory medium is, of course, chosen in depence on the separation to be made. As indicated above, a specific gravity of about 1.4 is in most cases suitable for separating non-metallic components from scrap. If it is desired to make a further separation of the resulting metallic fraction, for instance into a fraction mainly consisting of aluminum and aluminum alloys on the one hand, and a heavy-metal fraction (copper, lead, etc.) on the other, a second separation apparatus of the same type may be employed, using as separatory medium, for instance, a suspension of ferrosilicon in water, with a specific gravity of 3.0.

Above, the material to be separated has been referred to as 'scrap'; it will be clear that apparatus according to the invention can also be used for separating other materials, e.g. domestic refuse, in which case paper and lightweight organic components can be separated from heavier components, such as stone, rubber, glass and metals, by means of water as separating medium, after which, if so desired, the heavier fraction can be subjected to a further separatory treatment in a second washing tank, using a medium of higher specific gravity.

I claim:

1. Apparatus for separating particles differing in specific gravity by means of a liquid separatory medium, said apparatus comprising:

a washing tank for containing a predetermined volume of said separatory medium means defining an edge and including discharge means for accepting discharged particles therefrom;

first removing means for removing particles which are substantially floating in said separatory medium;

second removing means movable along the bottom of said washing tank for removing particles which gravitatingly settle through said separatory medium; and reciprocating means for reciprocating said second removing means between first and second extreme positions thereby transporting settled particles to said discharge means and wherein said second removing means comprises at least one collecting tray having an open end and being reciprocably movable along the bottom of said washing tank between said first and second extreme positions by virtue of said reciprocating means, whereby said collecting tray in said first extreme position is substantially centrally positioned on the bottom of said washing tank thereby collecting a predetermined amount of said settling particles and in said second extreme position tiltedly rests on said edge defining means so that said settled particles collected therein are encouraged to be discharged to said discharge means.

2. Apparatus as in claim 1 further comprising plate means defining a collecting plate movable along with said collecting tray so that particles settling through said separatory medium during the travel of said collecting tray between said first and second extreme positions are collected on said plate means and so that said collected particles thereon are encouraged to move into said collecting tray as said plate means and said collecting tray concurrently return to said first extreme position from said second extreme position.

3. Apparatus according to claim 1 or 2 further comprising a second collecting tray which, in a similar way as said first mentioned collecting tray, is movable between first and second extreme positions, said second collecting tray resting substantially centrally on the bottom of said washing tank when said first mentioned collecting tray has reached said second extreme position, and resting on said edge defining means opposite to said first mentioned collecting tray in said second extreme position when said first mentioned collecting tray is substantially centrally positioned on the bottom of said washing tank in said first extreme position.

4. Apparatus according to claim 1 or 2, wherein said collecting tray includes means for hingingly attaching said collecting tray to one or more arms fixed to a horizontal shaft and driving means for reciprocably turning said shaft thereby reciprocating said arms and said collecting tray hingingly attached thereto between said two extreme positions.

5. Apparatus for separating particles differing in specific gravity by means of a liquid separatory medium, using the float-and-sink method, said apparatus comprising:

a washing tank, reciprocating means, first particle removing means for removing floating particles, and second particle removing means movable along the bottom of said tank by virtue of said reciprocating means for removing settled particles, said reciprocating means being capable of moving said second particle removing means between two extreme positions and during movement from at least one of said extreme positions to the other extreme position capable of transporting and discharging settled particles over an edge of said washing tank, wherein said second removing means comprises first and second collecting trays each being hingedly attached to one or more arms fixed on a common horizontal shaft and said reciprocating means comprises driving means for reciprocably turning said shaft between said two extreme positions thereby reciprocably moving said collecting trays, wherein the first collecting tray in the first extreme position of said arms is located substantially centrally on the bottom of the washing tank so that settling particles are collected therein, and in the second extreme position tiltedly rests on a predetermined edge of the washing tank so that settled particles contained therein can be slidably discharged therefrom while said second collecting tray in said first extreme position of arms tiltedly rests on an edge opposite said predetermined edge of the washing tank, and in the second extreme position of said arms rests about centrally on the bottom of said washing tank.

6. Apparatus according to claim 5, further comprising a collecting plate fixed to at least one of said arms so that particles settling during the travel of said first and second collecting trays can be collected thereon and across which said collected particles can slide into the lowermost collecting tray when said first and second collecting trays are moving to a position substantially centrally located on the bottom of the washing tank.

* * * * *